United States Patent [19]

Bossetti

[11] Patent Number: 4,569,660

[45] Date of Patent: Feb. 11, 1986

[54] FURNACE FOR FIRING CERAMIC MATERIALS, HAVING A CROWN ELEMENT INCORPORATING THERMAL AND/OR MECHANICAL STRESS RESISTING MEANS

[75] Inventor: Renato Bossetti, Novara, Italy

[73] Assignee: S.I.T.I. Società Impianti Termoelettrici S.p.A., Novara, Italy

[21] Appl. No.: 624,515

[22] Filed: Jun. 25, 1984

[30] Foreign Application Priority Data

Jul. 12, 1983 [IT] Italy .....22021 A/83

[51] Int. Cl.[4] ..... F27B 9/00; E04B 5/30; F23M 5/02

[52] U.S. Cl. ..... 432/148; 52/323; 110/339

[58] Field of Search ..... 432/128, 148, 247; 52/320, 323, 778, 779; 110/339

[56] References Cited

U.S. PATENT DOCUMENTS

| | | | |
|---|---|---|---|
| 163,248 | 5/1875 | Post | 52/779 |
| 236,504 | 1/1881 | Lyons | 52/320 |
| 2,129,057 | 9/1938 | Greene | 432/148 |
| 3,503,165 | 3/1970 | Hardt | 52/607 |
| 4,154,576 | 5/1979 | Bossetti | 432/148 |

*Primary Examiner*—John J. Camby

*Attorney, Agent, or Firm*—Wenderoth, Lind & Ponack

[57] ABSTRACT

A ceramic material firing furnace, wherein heat is supplied through perforated plates provided on the furnace crown and furnace channel slabs. The plates have an upper face and lower face interconnected by ribs, and are supported by silicon carbide beams.

10 Claims, 4 Drawing Figures

FURNACE FOR FIRING CERAMIC MATERIALS, HAVING A CROWN ELEMENT INCORPORATING THERMAL AND/OR MECHANICAL STRESS RESISTING MEANS

BACKGROUND OF THE INVENTION

1. Field of the invention

This invention relates to a furnace for firing ceramic materials and having a crown element incorporating thermal and/or mechanical stress resisting means.

2. Description of the Prior Art

Known are, in particular from Italian Patents No. 27955 A.76 by this same applicant as well as from the first continuation in part thereto, presently pending for an independent patent grant filed under Ser. No. 25288 A/77, corresponding to U.S. Pat. No. 4,154,576, high thermal efficiency furnaces for firing ceramic materials, which are characterized in that they comprise a plurality of side-by-side chambers separated by partition walls, which chambers are defined at the top by a so-called crown wherethrough streams of hot combustion gases from the burners associated with such furnances—which open into the area defined by such crowns—are directed to the ceramic products to be cooked.

In such prior furnaces, the crowns are formed by so-called plates, having an upper face and lower face and being interconnected by partition ribs, whereby a number of channels, such as four, five, etc., are formed between the ribs. Such plates are supported at either ends by the furnace peripheral walls, and owing to the high thermal stress to which they are subjected, they may have a fairly small dimension between the furnace walls, thus imposing limitations to the furnance size. Between the plates, which are laid parallel to one another in side-by-side relationship and along the length of the furnace and tunnel forming it, suitable contoured patterns are provided for mutual engagement, especially at the plate mating areas.

Thus, it may be appreciated that with such plates, strength is solely provided by the plate structure, and that highly valuable materials must be used, which makes the plates a highly expensive item. Further, and as mentioned above, the plate width dimensions are restricted, which results in restrictions to the width dimension of the furnace itself.

Despite all these precautions, moreover, it is not unfrequent for the plates to develop cracks or break, which involves replacement and further aggravates the operating cost of the furnace, which must be deactivated.

SUMMARY OF THE INVENTION

It is an object of this invention to obviate such prior drawbacks by providing a high thermal efficiency furnace for firing ceramic materials, which affords the possibility of using, in the construction of the plates, materials which are not necessarily highly valuable ones, and accordingly, materials which are relatively inexpensive to produce and easily worked.

Another object of this invention is to prevent thermal stresses from being taken up by the plates themselves, whereby the latter may be made in relatively large sizes and the furnace width dimension and overall efficiency improved, since it is a well known fact that the larger the furnace the higher is its efficiency, or in other words, the thermal losses which adversely affect the furnace thermal efficiency may be further reduced.

It is a further object of the invention to reduce the likelihood of the plates breaking or cracking, because as mentioned, they are no longer required to provide resistance to mechanical stresses.

These and other objects are achieved by a high thermal efficiency furnace for firing ceramic materials, according to the invention, which comprises on the crown thereof high thermal strength plates having upper and lower faces interconnected by ribs defining spaces therebetween, said spaces being adapted to admit combustion gas streams generated by burners or equivalent means, and is characterized in that said plates are supported on silicon carbide beams having high mechanical and excellent thermal strength features.

BRIEF DESCRIPTION OF THE DRAWINGS

Further features and advantages of the invention will be more readily understood from the following description, with reference to the accompanying drawings illustrating an exemplary embodiment thereof, and where.

DETAILED DESCRIPTION OF THE PREFERRED EMBODIMENTS

Figure 1:
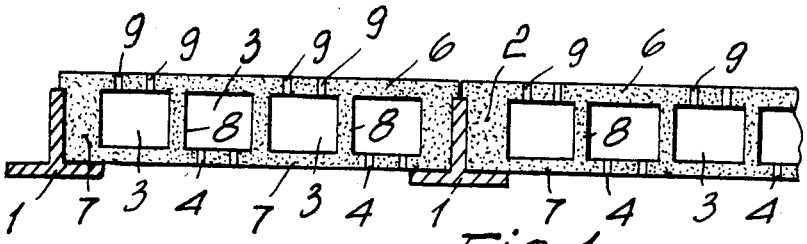
FIG. 1 is a longitudinal section view, taken along the longitudinal axis of the furnace, of a crown according to the invention incorporating beams laid in accordance with the inventive arrangement and plates supported thereon.

Making reference to the drawings, the numeral 1 generally designates a high mechanical and thermal strength beam formed from silicon carbide and having any desired shape, such as an inverted "T" cross-sectional configuration, or an I-like, square, rectangular, tubular, etc. cross-section, the beam being laid crosswise to the lengthwise direction of the furnace.

The same arrangement of the beam 1 is repeated for a plurality of like beams, which when laid at suitable distances apart, would span the whole surface of the furnace. Located between adjoining beams, are one or more plates formed from a refractory material and generally indicated at 2 in the drawings. Each plate is supported on two adjacent beams for the entire length thereof through any selected securing or interlocking arrangement. The plates 2 are constructed to provide, over the entire length thereof, spaces 3 which are included between upper portions or faces 6 and lower portions or faces 7 and intermediate ribs 8 of the plates.

The two faces or portions 6 and 7 are formed with downwardly directed holes 4 and upwardly directed holes 9, each plate having both hole types communicating in alternating fashion with alternate spaces 3. Thus, along the longitudinal direction of the furnace are arranged rows of holes which alternately are directed downwards and upwards from alternate spaces 3. A burner 15 may be inserted through each space 3 to supply hot gases effective to create a slight overpressure within the space, thus causing hot gas jets to issue alternately upwards and downwards through the holes 9 and 4.

Such succession of perforated plates supported on silicon carbide beams as described, forms, in a conventional construction furnace having two superimposed channels, generally indicated at 10, the base of an upper channel or chamber 11 and crown of a lower channel or chamber 12. Such plates are indicated at 22 in the cross-sectional view of FIG. 2.

The crown of the upper channel 11 has, according to the invention, a similar construction including plates 14 supported on silicon carbide beams 25 and having an upper portion or surface 13 and lower portion or surface 16. In the instance of the furnace upper channel crown plates, the outlet holes for the gases from the burners 15 are all directed downwards, whereby they do not follow the alternate pattern described above in connection with the intermediate plates indicated at 22.

Likewise, the plates 19 of the furnace lower channel 12 slab have holes 20 all of which are directed upwards.

Figure 2:
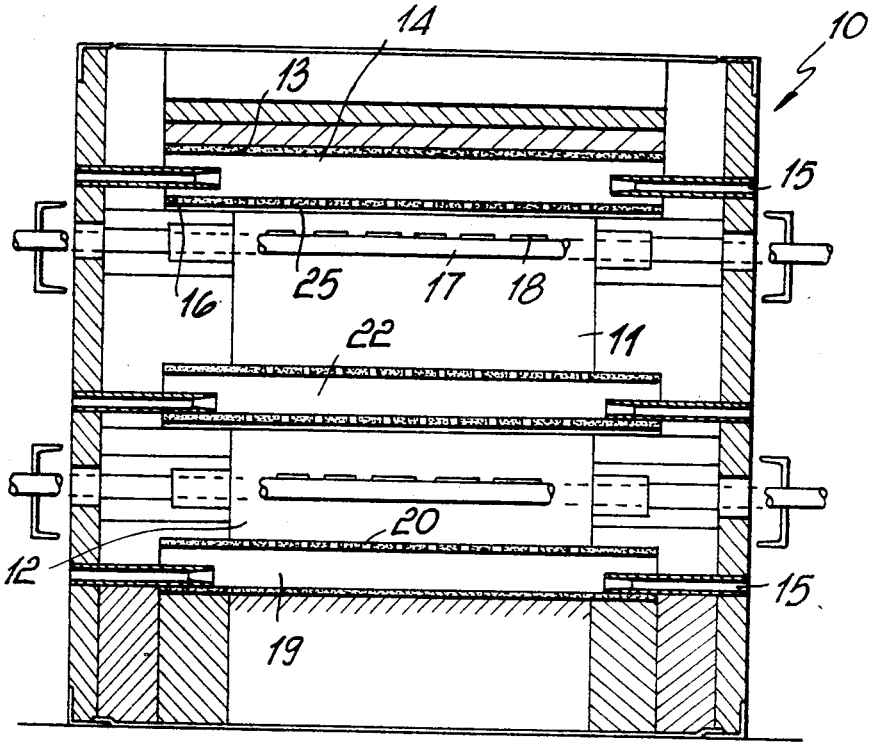
FIG. 2 is a cross-sectional view of a furnace of the type having two superimposed chambers and constructed in accordance with this invention.

FIG. 2 shows a conventional system of transporting ceramic material tiles 18 by means of a set of rollers 17 through the entire length of the furnace.

This invention further provides for modified embodiments which are well within the capability of a skilled person, while all utilizing the same inventive priciple. Thus, an an example, the plates, which in FIG. 2 are of single piece construction, may be made up of several parts, preferably modular ones, whereby the spaces indicated at 3 are not continuous over the entire length thereof but rather formed by various successive chambers which are all adequately supported by pairs of adjoining silicon carbide beams, as already described hereinabove.

Figure 3:
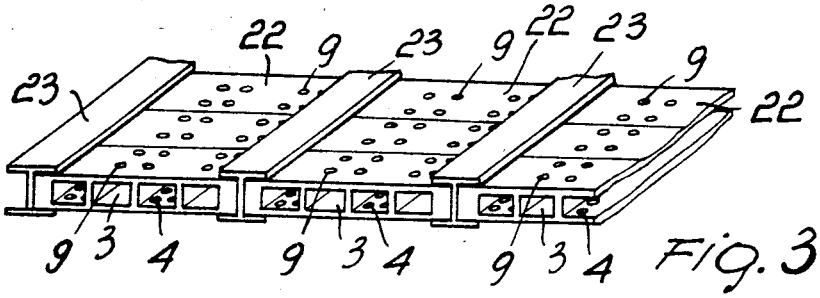
FIG. 3 is a perspective view of a furnace crown according to the invention, incorporating beams as provided by the inventive arrangement and modular plates supported thereon.

This modified embodiment is illustrated by FIG. 3 of the drawings. A pair of silicon carbide beams 23 carries, in the embodiment of FIG. 3, plates 22 which are provided with alternately upwards and downwards directed holes. Each space 3 results, therefore, from the contiguous arrangement of three plates 22.

Figure 4:
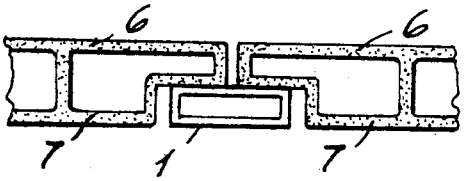
FIG. 4 is a cross-sectional view through another embodiment of this invention, wherein the silicon carbide beams have a rectangular tubular cross-sectional configuration.

FIG. 4 shows another variation of the support arrangement on the silicon carbide beams for the plates. The silicon carbide beam 1 has a rectangular shape. The plates are provided, between the upper portion or surface 6 and lower portion or surface 7, with a special groove enveloping or accommodating the shape of the silicon carbide beam.

It may be appreciated that electric heating could be used by accommodating a heating system within the space 3, thereby the whole plate would provide a radiating surface. In this modified embodiment, it is not necessary that the plates be perforated, since heating is provided, rather than by convection, solely by radiation from the plate surfaces.

As mentioned, the silicon carbide beams may have any desired shape, on condition that an adequate arrangement be provided for engaging them with the plates.

It has been found that in practice the apparatus just described can easily operate in thermally critical conditions without incurring the aforesaid prior disadvantages. In particular, this invention enables a set of furnace plates to be formed from simple, readily available and low cost refractory materials. Furthermore, an overall stronger construction can be achieved because the load is suitably taken up by the silicon carbide beams. It is also possible to increase the furnace width beyond the limits imposed by the prior art, to thus achieve improved output capacity and overall thermal efficiency for the furnace.

I claim:

1. In a furnace for firing ceramic materials, said furnace being of the type having extending longitudinally therethrough at least two superposed furnace chambers, each said chamber having therein a horizontal row of horizontal rollers for moving longitudinally through said chamber ceramic materials to be fired, and means positioned between each adjacent superposed pair of said chambers for distributing heat to both said chambers for firing the respective ceramic materials moving therethrough, the improvement wherein said heat distributing means comprises:

a horizontal row of silicon carbide beams positioned between said pair of chambers, each said beam extending across said furnace transversely of the longitudinal direction of movement of the ceramic materials, and adjacent said beams being spaced from each other in said longitudinal direction;

a plurality of refractory plates supported by said beams, each said plate having upper and lower portions connected by ribs and defining a plurality of longitudinal internal spaces in said plate, each said plate extending entirely between and being supported at opposite ends thereof in said longitudinal direction by a pair of adjacent said beams with said spaces extending transversely of said longitudinal direction; and means for supplying heat to said spaced such that said heat is transmitted upwardly and downwardly from said plate to said pair of superposed chambers.

2. The improvement claimed in claim 1, wherein each said plate extends transversely entirely across said furnace.

3. The improvement claimed in claim 1, wherein a plurality of said plates are abutted to extend transversely across said furnace.

4. The improvement claimed in claim 1, wherein at least said lower portion of each said plate has extending therethrough openings, and said heat supplying means comprise means for supplying combustion gas to said spaces and expelling said combustion gases through said openings.

5. The improvement claimed in claim 4, wherein each said plate has openings extending through both said lower and upper portions thereof.

6. The improvement claimed in claim 4, wherein said combustion gas supplying means comprises burners for supplying flue gases to said spaces.

7. The improvement claimed in claim 1, wherein said heat supplying means comprises electric resistance heaters extending into said spaces for heating said plates, such that said upper and lower portions of said plates radiate heat into said pair of superposed chambers.

8. The improvement claimed in claim 1, wherein each said beam has an inverted T-shaped cross-sectional configuration.

9. The improvement claimed in claim 1, wherein each said beam has a I-shaped cross-sectional configuration.

10. The improvement claimed in claim 1, wherein each said plate has a rectangular cross-sectional configuration.

* * * * *